US005816528A

United States Patent [19]

Ekström et al.

[11] Patent Number: 5,816,528

[45] Date of Patent: Oct. 6, 1998

[54] REEL-UP WITH DOUBLE SECONDARY UNITS FOR REELING A RUNNING WEB IN A PAPER MACHINE

[75] Inventors: Göran Ekström, Väse; Roland Karlsson, Karlstad; Tommy Karlsson, Göteborg; Lars-Erik Önnerlöv, Karlstad, all of Sweden

[73] Assignee: Valmet-Karlstad AB, Karlstad, Sweden

[21] Appl. No.: 955,160

[22] Filed: Oct. 21, 1997

[30] Foreign Application Priority Data

Oct. 21, 1996 [SE] Sweden ..... 9603866

[51] Int. Cl.[6] ..... B65H 18/16

[52] U.S. Cl. ..... 242/541.5; 242/541.1

[58] Field of Search ..... 242/541.1, 541.5, 242/541.6

[56] References Cited

U.S. PATENT DOCUMENTS

| | | | |
|---|---|---|---|
| 3,614,011 | 10/1971 | Karr . | |
| 4,143,828 | 3/1979 | Braun et al. . | |
| 4,175,714 | 11/1979 | Dreher . | |
| 4,283,023 | 8/1981 | Braun et al. . | |
| 4,934,619 | 6/1990 | Snygg . | |
| 5,251,835 | 10/1993 | Kyytsonen | 242/541.1 |
| 5,370,327 | 12/1994 | Adamski . | |
| 5,375,790 | 12/1994 | Svanqvist | 242/541.1 |
| 5,393,008 | 2/1995 | Kyytsonen et al. . | |
| 5,520,354 | 5/1996 | Adamski . | |
| 5,531,396 | 7/1996 | Kinnunen et al. . | |
| 5,544,841 | 8/1996 | Didier et al. | 242/541.1 |
| 5,560,566 | 10/1996 | Bagnato | 242/541.1 |
| 5,673,870 | 10/1997 | Fielding et al. . | |

FOREIGN PATENT DOCUMENTS

| | | |
|---|---|---|
| 1 574 632 | 2/1971 | Germany . |

*Primary Examiner*—John P. Darling
*Attorney, Agent, or Firm*—Bell Seltzer Intellectual Property Law Group of Alston & Bird, LLP

[57] ABSTRACT

A reel-up in which paper is reeled up on reeling drums to form paper reels, said reel-up having two parallel stand members; a surface winding mechanism in the form of a rotating surface winding drum and/or a belt to carry the web and deliver it to one of said reeling drums or a paper reel formed or being formed thereon; and a secondary system including first and second secondary units for alternate receipt of new reeling drums. Each secondary unit, includes an outer first secondary member and an inner second secondary member, each of the secondary members having a linearly movable secondary body, an actuator for moving the secondary body, and a press device to maintain a predetermined linear pressure in the nip between the surface winding means and the paper reel as it increases in size. Each secondary body includes a bottom plate and a pivot unit pivotably journalled in a journalling element for turning between a position folded up from the bottom plate for collection of an empty reeling drum and a production position folded down to the bottom plate for reeling the web.

22 Claims, 15 Drawing Sheets

22
50
36
47
35
57
52
43
46
38
53
44
49
56
51
45
55
48
41
54
42
34
24
40
37
39

REEL-UP WITH DOUBLE SECONDARY UNITS FOR REELING A RUNNING WEB IN A PAPER MACHINE

FIELD OF THE INVENTION

The present invention relates to papermaking machines and more particularly relates to reel-ups for reeling up a paper web as the web exits a papermaking machine.

BACKGROUND OF THE INVENTION

In reel-ups used hitherto for reeling paper reels, two systems are usually used to enable continuous production to be maintained, namely a primary system which takes over an empty reeling drum from lowering arms and, when the paper web has been wound a few turns on the drum, a secondary system where reeling is continued to a finished reel of paper. In the present context we have chosen to use the prefix "secondary" in the terms "secondary system", "secondary unit", "secondary member", "secondary body", etc., even in those cases where the reel-up lacks a primary system. The secondary system usually comprises either a pair of secondary arms or a pair of secondary carriages which are pivoted or displaced linearly depending on the increase in diameter of the paper reel.

In reel-ups of the first type, i.e., with secondary arms, the reeling occurs, briefly, as follows: An empty reeling drum is transferred from a stock of drums to primary forks which bring it into contact with a driven surface winding drum over which the web runs, in order to initiate reeling of the web. Considerable friction thus occurs between the reeling drum and the surface winding drum, so that the reeling drum is generally caused to rotate at the same speed as the surface winding drum before coming into contact with this. The reeling drum is then moved along the periphery of the surface winding drum, down to a horizontal stand member where the secondary arms take over control of the reeling drum. Continued reeling to a finished reel is achieved in that the secondary arms, turning around a joint, follow the reel along its horizontal movement while press devices in the form of rotating, journalled press rolls, arranged on the secondary arms, act against bearing houses arranged on the end portions of the reeling drum. A desired, controllable linear pressure is thus maintained in the nip between the surface winding drum and the paper reel as it increases in size. However, the pivoting movement of the secondary arms causes the linear pressure to be uneven since the press reels press against the reeling drum in a contact point following the envelope surface of the bearing house in an arc-shaped movement, giving both a horizontal and a vertical movement component. Reel-ups with secondary arms are described in the following patent specifications, for instance: U.S. Pat. No. 4,143,828, U.S. Pat. No. 4,283,023, U.S. Pat. No. 4,175,714, U.S. Pat. No. 3,614,011 and U.S. Pat. No. 5,520,354.

Another deficiency in reel-ups with secondary arms is that the diameter of the finished paper reel is limited to the span of the secondary arms and if a larger paper reel is required, secondary systems consisting of linearly movable secondary carriages provided with press devices must be used instead. The problem of the uneven linear pressure caused by the pivoting movement of the secondary arms is then also solved since the press devices on the carriages only have a horizontal movement component during movement of the reeling drum in relation to the surface winding drum. It is also less complicated to measure the growth of the reel with the aid of the horizontal movement of the carriage than with an angle transducer on a secondary arm.

Reel-ups with linearly movable secondary carriages are described in the following patent specifications, for instance: U.S. Pat. No. 4,934,619 and U.S. Pat. No. 5,370,327. With increasing reeling velocities and increasing size of the paper reel, however, slipping may occur between the surface winding drum and the paper reel. This problem is solved by equipping the secondary system with central driving of the reeling drum. Central driving means that the reeling drum is coupled to a drive means with the aid of a coupling device disposed at the ends of the reeling drum. Central driving also enables variation of the linear pressure within a wide area so that compression of the paper web in the nip between paper reel and surface winding drum can be reduced.

A particular problem occurs in the manufacture of soft paper such as "soft tissue" and similar paper used for sanitary purposes, since the linear pressure in the nip must be low to avoid negative effects in the paper reel. The individual layers in the reel may be wound too loosely which causes slipping between adjacent layers, causing them to move axially as well.

In order to maintain the desired high stretchability in the tissue paper, an endless belt may be used as surface winding means, either on its own or together with a surface winding drum. The endless belt also alleviates other control problems in the form of vibrations or the like in the web prior to the surface winding drum. Reel-ups with endless belts are described in the following patent specifications, for instance: U.S. Pat. No. 4,143,828, U.S. Pat. No. 4,283,023, U.S. Pat. No. 5,531,396 and U.S. Pat. No. 4,175,714.

Central driving is described in the following patent specifications, for instance: U.S. Pat. No. 4,934,619, U.S. Pat. No. 5,370,327, U.S. Pat. No. 5,520,354, SE-469 071 and SE-469 072. Problems still arise even with the use of central driving. When transferring the reeling drum from the primary system to the secondary system, a changeover must be effected between different drive means. The transmission exchange affects the linear pressure negatively in the nip between the reeling drum and the surface winding means since a temporary pressure increase occurs in the nip. To optimize reeling, the same drive means should be connected throughout the reeling procedure from the start with an empty reeling drum, to finished reel. If no transfer takes place between two drive systems, the variation in tension otherwise occurring in the paper web is also To achieve this it is already known to use double sets of secondary carriages which alternate with each other and enable omission of the primary arms altogether. In this way a single drive means connected to one of the carriage pairs can follow the reeling drum throughout the reeling process to a finished reel. A reel-up of this type is described in U.S. Pat. No. 5,370,327. However, a special stand is required for the reel-up described therein. To enable the carriage pairs to pass each other the stand is provided with two pairs of parallel rails, pivotably journalled in the downstream end of the stand. The surface winding drum has also been arranged vertically movable. This means that the existing reel-ups cannot be directly equipped with double secondary units, nor can they easily be converted to reel-ups with double secondary units.

Furthermore, drive means for central driving according to U.S. Pat. No. 5,370,327 have been arranged on each side of the stand, on separate support elements. The drive means and each secondary unit have separate actuators for the to and from movement along the separate support elements. The drive means is also disconnected before the reeling drum has been grasped by the secondary unit. This creates difficulties when aligning and coupling together the reeling drum with the central driving during operation. As will be understood, the stand and support elements, arranged beside each other, also require a considerable amount of space.

SUMMARY OF THE INVENTION

These and other deficiencies of the prior art are overcome by the present invention which includes two elongate parallel stand members and a surface winding means arranged at the upstream end of the stand members and being in the form of a rotating surface winding drum and/or a belt to carry the web and deliver it to one of the reeling drums or a paper reel formed or being formed thereon. Advantageously, the invention includes a secondary system consisting of first and second secondary units for alternate receipt of new reeling drums, each secondary unit comprising a first secondary member arranged externally on the first and second stand members, respectively, and a second secondary member arranged internally on the second and first stand members, respectively.

Each of the secondary units includes a platform secured to the stand member, a secondary body linearly movable on the platform, an actuator for moving the secondary body, and a press device arranged on the secondary body to press against the bearing house of the reeling drum so that a predetermined linear pressure is maintained in the nip between the surface winding means and the paper reel as it increases in size. The reel-up also includes a device for moving the reeling drum from a reel stock located upstream of the stand members, to the secondary unit which is to commence a reeling operation.

The reel-up according to the present invention is further characterized in that each secondary body comprises a bottom plate, journalling elements carried by the bottom plate, and a pivot unit pivotably journalled in said journalling element for turning about an axis of pivot, that is parallel with a reeling drum operating in the reel-up, between a collection position folded up from the bottom plate for collection of an empty reeling drum and a production position folded down to the bottom plate for reeling the web onto the collected reeling drum. The press device is carried by the pivot unit.

BRIEF DESCRIPTION OF THE DRAWINGS

The invention will be described in more detail in the following with reference to the drawings.

FIGS. 7–12 are schematic cross sections of components in the reel-up according to FIG. 1, and illustrate various operating positions during the reeling process.

DETAILED DESCRIPTION OF THE PREFERRED EMBODIMENTS

Figure 1:
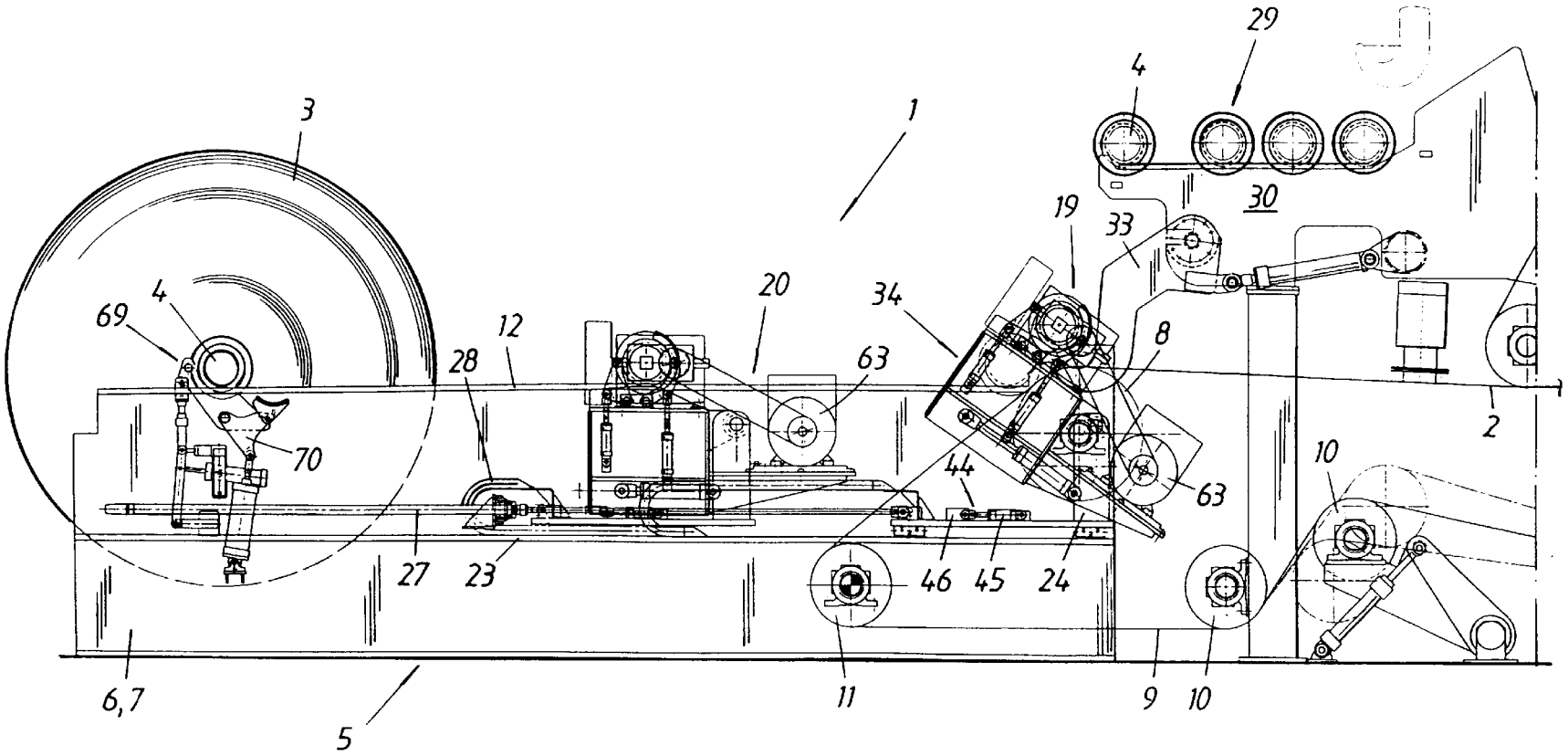
FIG. 1 is a longitudinal section through a reel-up according to the invention comprising an endless running belt and double secondary units, showing a first embodiment with both the new and the finished paper reel in contact with the endless belt.
Figure 2:
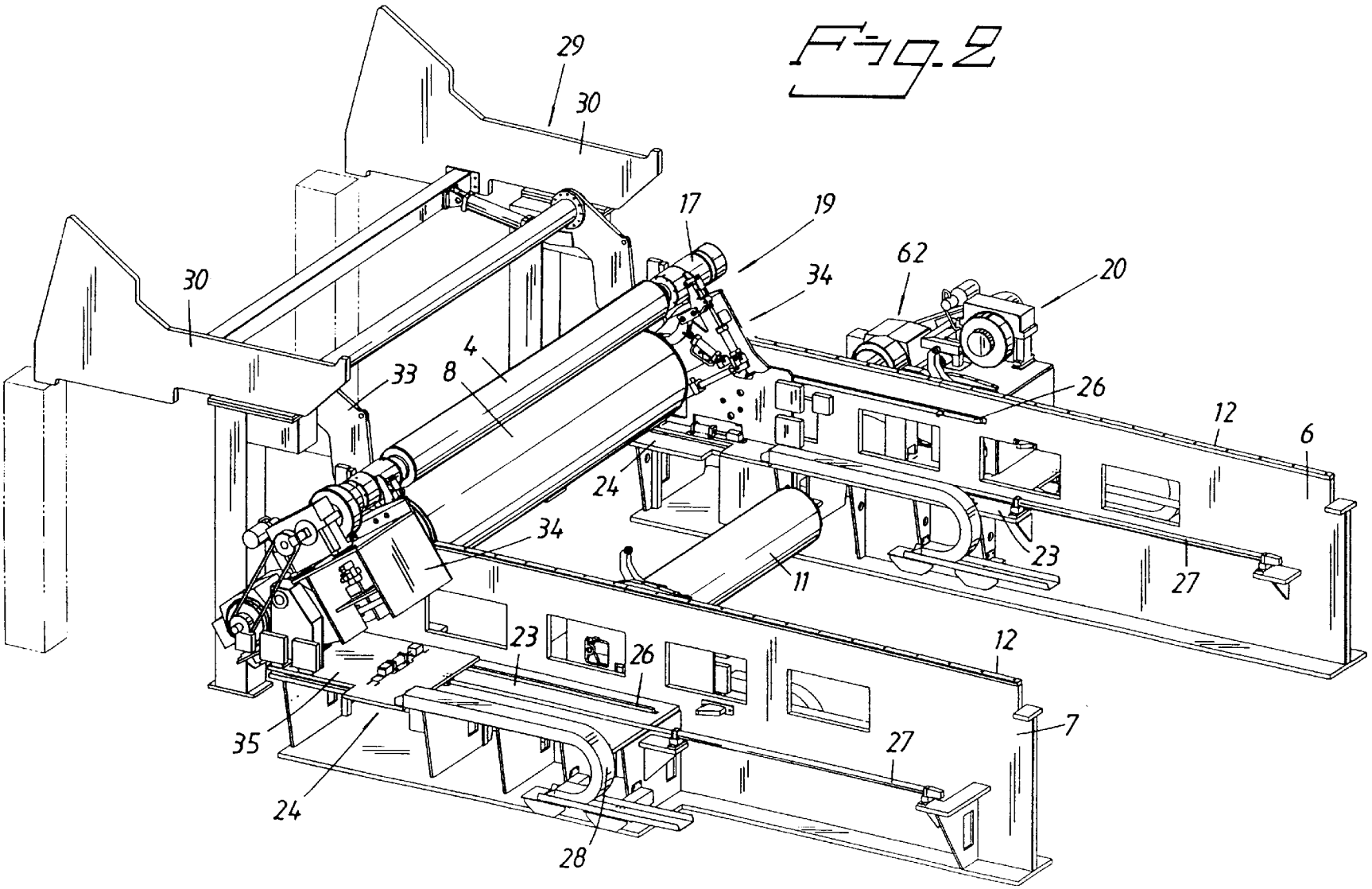
FIG. 2 is a schematic perspective view of parts of the reel-up according to FIG. 1 seen from one long side of the reel-up.
Figure 3:
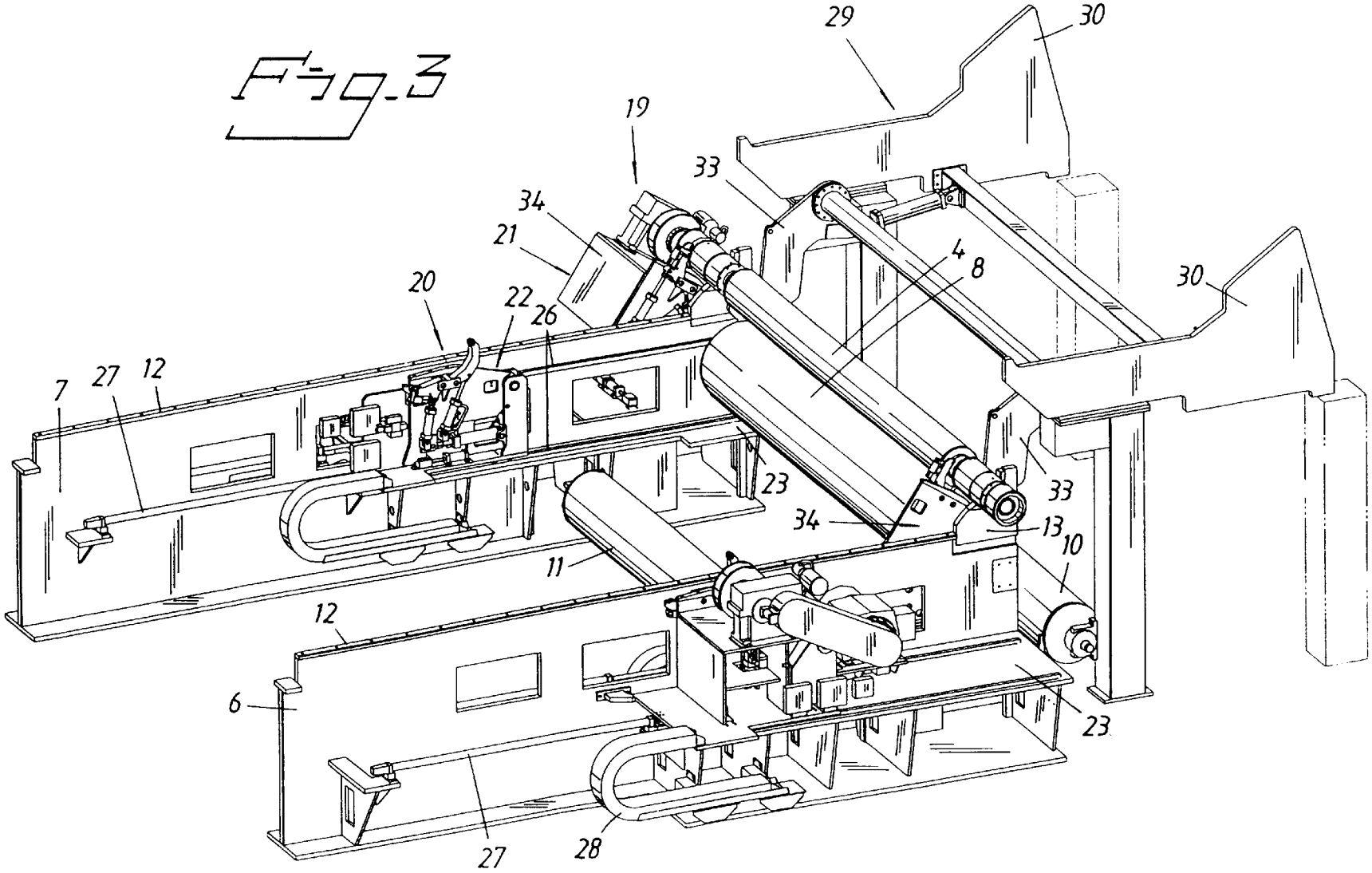
FIG. 3 is a perspective view of parts of the reel-up according to FIG. 1 seen from the opposite long side.
Figure 4:
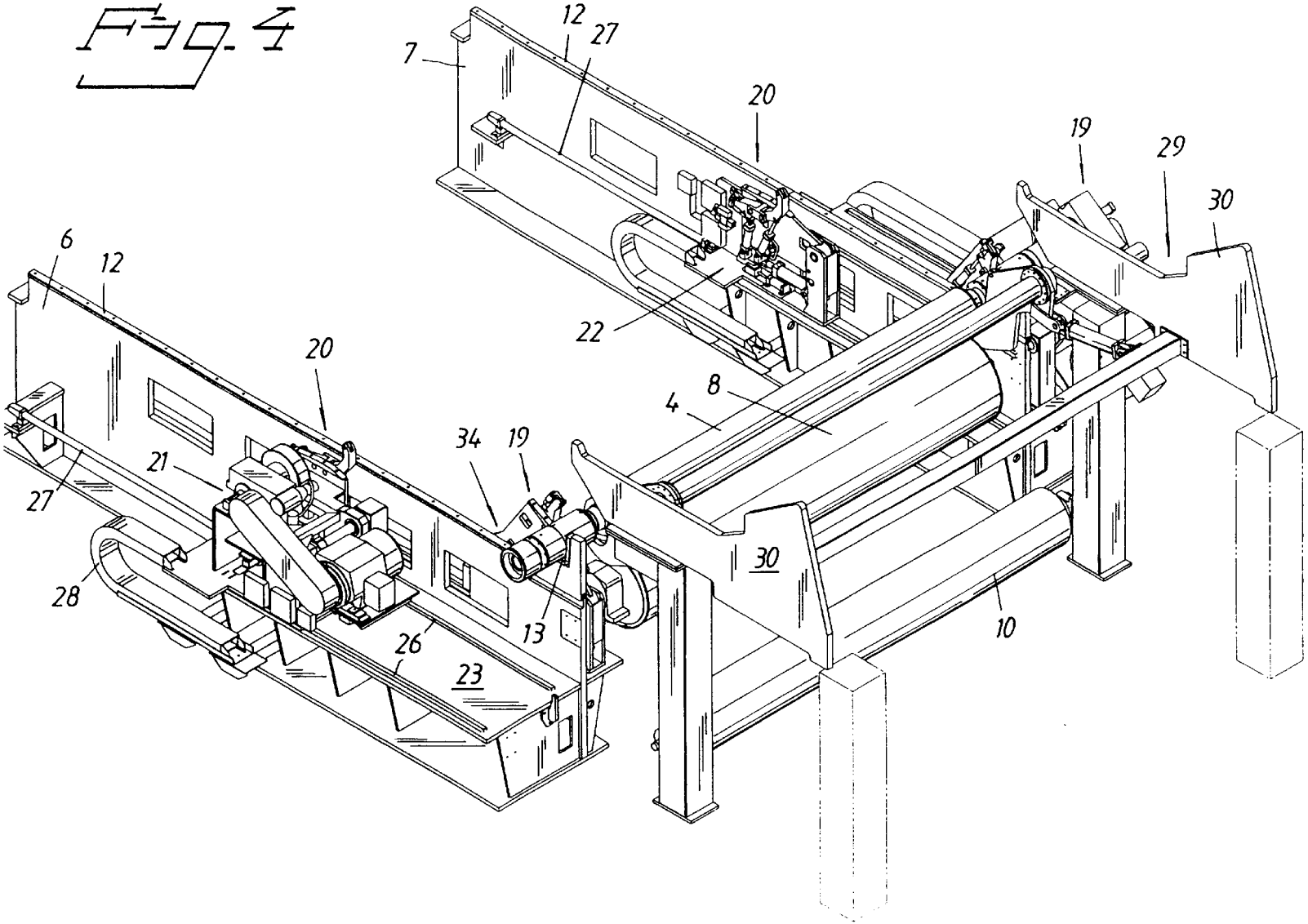
FIG. 4 is a perspective view of parts of the reel-up according to FIG. 1 seen upstream of the reel-up.

FIGS. 1–4 show schematically in side view and perspective views a reel-up in a paper machine in which paper is manufactured in a continuous web 2. Paper reels 3 are reeled continuously in the reel-up on a core in the form of a reeling drum 4. The reel-up 1 comprises a stand 5 with first and second identical, elongate, parallel stand members 6, 7. A surface winding drum 8 is rotatably journalled in the stand members 6, 7. Over the surface winding drum 8 runs an endless belt 9 which supports the paper web 2 coming from a drying section with a through-blow cylinder and/or Yankee cylinder in a tissue paper machine, on its way to the reel-up 1. A drive motor (not shown) gives the surface winding drum 8 a peripheral speed corresponding to that of the belt 9 and thus also the speed at which the paper web 2 is fed forward. The surface winding drum 8 may alternatively be driven by the belt 9 which runs over a plurality of rolls 10 one of which, e.g. the belt turning roll 11, is then driving.

A horizontal rail 12 is also rigidly mounted above each stand member 6, 7. The rail 12 commences with a raised lowering surface 13 (see FIG. 3) for the reeling drum 4 in the upstream end of the reel-up 1, seen in the feed direction of the paper web 2. The rails 12 are arranged slightly further apart from each other than the width of the paper web 2. The reeling drum 4 (see FIG. 16) is provided at each end with a braking drum 14 comprising a coupling device 15 with internal toothed rim 16 and a bearing house 17 situated inside the coupling device 15 and provided with a groove 18 running peripherally around it.

The reel-up 1 comprises a secondary system consisting of a first secondary unit 19 and a second secondary unit 20, said secondary units being reversed in relation to each other and the stand members 6, 7. Each secondary unit 19, 20 has a first outer secondary member 21 arranged externally on the first and second stand members 6, 7, respectively, and an inner second secondary member 22 arranged internally on the second and first stand members 7, 6, respectively. Each secondary member 21, 22 comprises a platform 23 and a secondary body 24 movable linearly thereon. Each platform 23 is rigidly mounted to its stand member 6, 7, and has one or more guide tracks 26 arranged to guide the secondary body 24 and also to reduce the friction during its to and from movements to a minimum. This may suitably be effected by means of some form of bearing element such as roller or slide bearings (not shown) . Such guide tracks 26 are also arranged horizontally on the vertical inner sides of the stand members 6, 7, a little way below the rail 12.

Each secondary member 21, 22 also includes an actuator 27 for moving the secondary body 24, which actuator 27 may consist of a hydraulic or pneumatic cylinder, for instance. Said actuator 27 is attached by one end to the secondary body 24 and by its other end to the stand member 6, 7. The movements along the guide tracks 26 of the two secondary bodies 24 in one and the same secondary unit 19, 20, respectively, are synchronized with one another. Outermost on each platform 23 cables are arranged in a cable package 28 which is flexible, allowing it to follow the to and from movements of the secondary body 24.

Each secondary unit 19, 20 supports a reeling drum 4 throughout an entire production phase from empty drum 4 to finished paper reel 3, after which this is transferred to the rails 12 together with its reeling drum.

At the upstream end of the reel-up 1, above the surface winding drum 8, is a stock 29 of empty reeling drums 4. The stock 29 comprises a substantially horizontal shelf 30 on which empty reeling drums 4 rest side by side and parallel to the surface winding drum 8, ready for use in the reel-up 1. Actuating means (not shown) comprising support arms and an actuator, consisting of a piston cylinder in the described embodiment, control the gradual forward feeding of new reeling drums 4. Each new reeling drum 4 is transferred from the stock 29 to the lowering surfaces 13 of the rails 12 by means of a pair of lowering arms 33 when the growing paper reel 3 located downstream approaches a predetermined size. The reeling drum 4 rests temporarily on the lowering surfaces 13, the peripheral groove 18 of the reeling drum 4 cooperating with the rails 12 on said lowering surfaces 13 of the rails 12.

Figure 5:
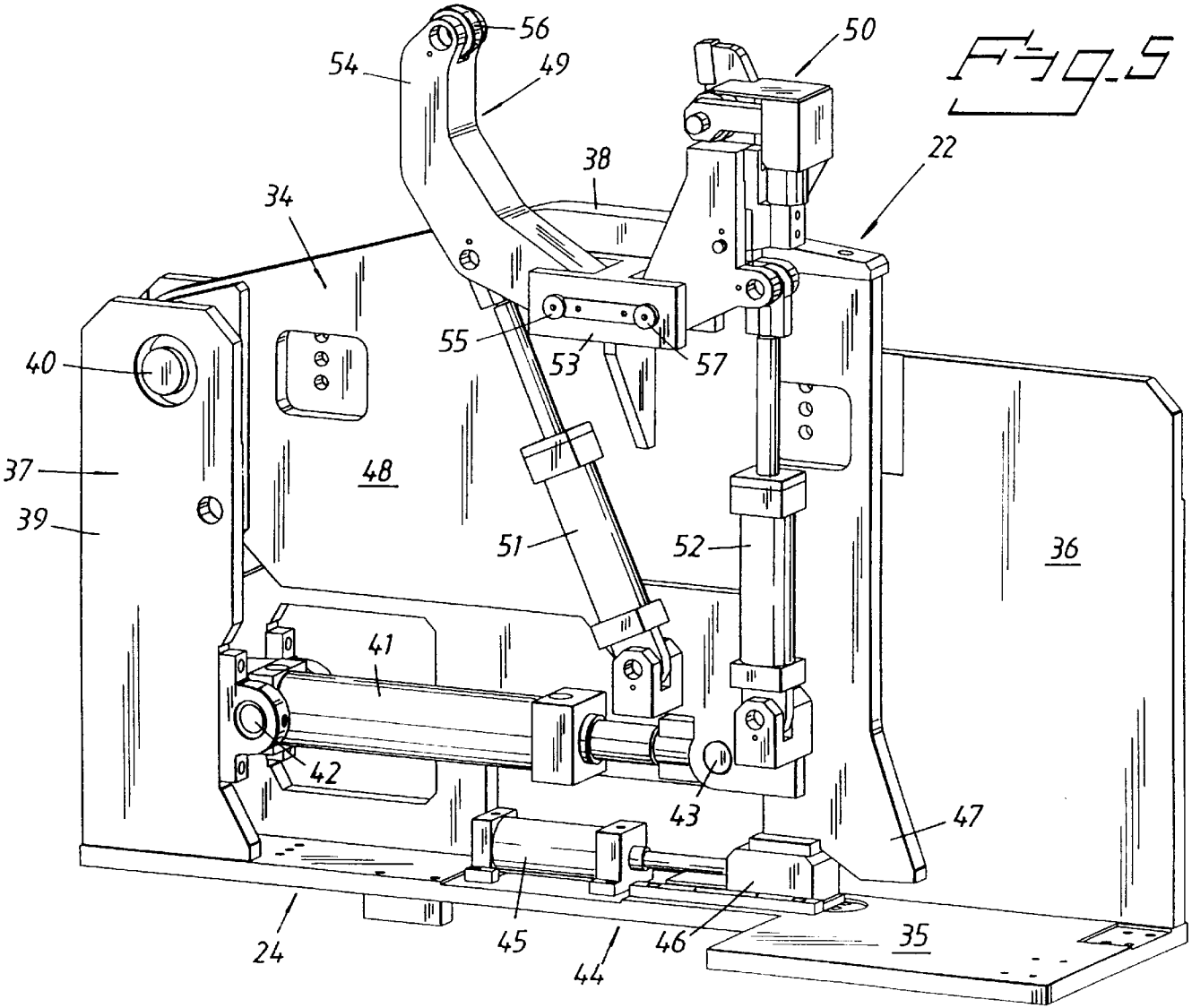
FIG. 5 is a perspective view of the inner secondary member of one secondary unit according to FIG. 1.
Figure 6:
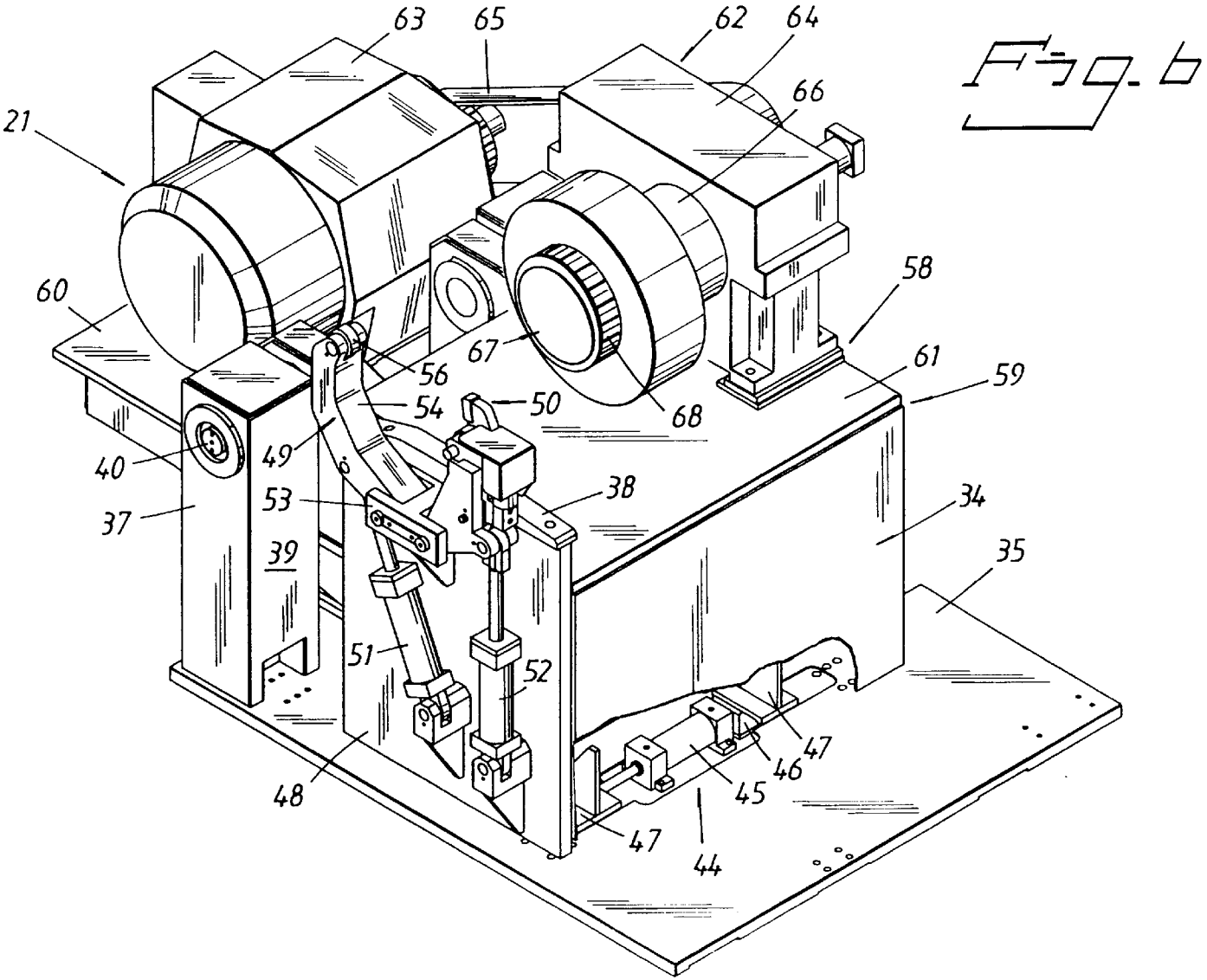
FIG. 6 is a perspective view of an outer secondary member of one secondary unit according to FIG. 1 with a part of the box part cut away in order to show the position-determining member with its actuator.

In the embodiment shown (see FIGS. 5 and 6) each secondary body 24 consists of a carriage or sledge that runs along the track or tracks 26 in the platform 23. Each secondary body 24 comprises a pivot unit 34 for cooperation with the reeling drum 4, a bottom plate 35 and a side plate 36 protruding at a right angle thereto, which is arranged along the edge of the bottom plate 35 located nearest to the stand member 7, 6. The bottom plate 35 has journalling elements 37 for pivotable journalling of the pivot unit 34 about an axis of pivot that is parallel with an active reeling drum 4. The two pivot units 34 of the secondary units 19, 20 are arranged to receive the reeling drum 4 from the lowering arms 33 so that the end portions of the reeling drum 4 rest with their bearing houses 17 on rails 38, described below, in the pivot units 34.

At the secondary body 24 of the inner secondary member 22 (see FIG. 5), the bottom plate 35 is oblong in shape and said journalling element 37 comprises a beam 39 extending vertically up from the bottom plate 35 at the end nearest the surface winding drum 8, and a bearing pin 40 arranged at the upper end of the beam 39 and forming said axis of pivot. The pivot unit 34 is pivotable about said bearing pin 40 with the aid of an actuator 41 pivotably attached by one end to the lower end portion of the beam 39 and by its other end to the pivot unit 34 with the aid of guide pins 42, 43. The actuator 41 consists of a pneumatic or hydraulic piston cylinder.

On the bottom plate 35 is a position determiner 44 comprising an actuator 45 and a horizontally movable level block 46 for cooperation with a fixed shoulder 47 on the pivot unit 34 to fit said level block 46. In the shown embodiment this shoulder is step-shaped. Since the level block 46 of the position determiner 44 can be set in two positions, one active and one passive, by means of the actuator 45, the vertical position of the pivot unit 34 can be controlled from an upper production position to a lower reel-exchange position. This allows the secondary unit 19 or 20 on its way back upstream after having delivered a finished reel 3 downstream, to pass below the paper reel 3 in the process of being formed in the other secondary unit 20 and 19, respectively.

The pivot unit 34 comprises a substantially rectangular, vertical support plate 48, a locking member 49, a press device 50 and actuators 51, 52 for each of these. The press device 50 is intended to press against the bearing house 17 of the reeling drum 4 so that a predetermined linear pressure is maintained in the nip between the surface winding drum 8 and the paper reel 3 during growth of the latter. Said rail 38 is mounted along the upper edge of the support plate 48, said rail 38 being intended to carry the bearing house 17 of the reeling drum 4 with its coupling device 15 situated on the outer side of the rail 38 during linear movement of the secondary body 24 away from the driving surface winding drum 8.

An H-shaped connecting element 53 is rigidly secured horizontally along one long side to the support plate 48. The locking device 49 consists of an arc-shaped arm 54 hinged at its lower end to the above-mentioned H-shaped connecting element 53 by means of a horizontal bearing pin 55 extending parallel to the central axis of the reeling drum 4, between the two legs of the H-shaped connecting element 53 arranged upstream. The actuator 51 of the locking member 49 extends between a lower attachment point on the support plate 48 of the pivot unit and the locking arm 54 and is joined to these in hinged manner at the ends. The free upper end of the locking device 49 supports a roll 56 intended to cooperate with the axis of the reeling drum 4 when the locking member 49 is in its upper production position. The press device 50 is situated immediately opposite the locking member 49 in the two legs of the H-shaped connecting member 53 and is connected therewith in hinged manner in the same way as the locking member 49.

The press device 50 is also pivotably journalled by means of a bearing pin 57, influenced by an actuator 52 extending between the press device 50 and the support plate 48 of the pivot unit 34. The locking member 49 and press device 50 of the two secondary members together form a gripping device for the reeling drum 4. The reeling drum 4 is supported by the gripping devices 49, 50 while at the same time being freely rotatable within these throughout the entire reeling phase of the paper reel 3.

The outer secondary member 21 of each secondary unit 19, 20, which is thus situated on the outer side of the opposite stand member 6, 7, respectively, is shaped somewhat differently. This is described in more detail with reference to FIG. 6, the same designations being used for equivalent construction elements. In the same way as for the inner secondary member 22 described above, the outer secondary member 21 has a secondary body 24 and a pivot unit 34. However, the bottom plate 35 of the outer secondary body 24 is somewhat larger than the bottom plate 35 of the inner secondary body 24.

The journalling element 37 for pivotable journalling of the pivot unit 34 about a bearing shaft comprises two vertical beams 39, each arranged at one edge extending parallel to the stand member 6, 7, and two bearing pins 40 arranged at the upper end parts of the beams 39 and forming said bearing shaft. A position determiner 44 with actuator 45 is arranged horizontally on the bottom plate 35 at right angles to the side member 6, 7. The pivot unit 34 comprises a stand 58 with a box-shaped part 59 and a platform 60 projecting therefrom. The box part 59 is provided with an upper horizontal plate 61 on which parts of a means 62 for central driving of the reeling drum 4 are arranged. A locking member 49, press device 50 and actuators 51, 52 are arranged on a vertical support plate 48 in similar manner to that described for the inner secondary member 22, the support plate 48 being firmly secured to the inner vertical wall of said box part 59 forming a part of the pivotable stand 58. Since the central driving means 62 is mounted on the pivot unit 34 it is linearly displaceable together with the secondary body 24 in a direction parallel to the rails 12.

The central drive means 62 comprises a drive motor 63 firmly secured on the platform 60, a transmission box 64 firmly secured to the box part 59 and a power transmission means 65 arranged between them which, in the embodiment shown, consists of a toothed belt. A rotatable shaft 66 projects from the transmission box 64 in a direction parallel to the reeling drum 4. A coupling device 67 is arranged on this shaft 66 at its inner end facing the stand member 6, 7. The coupling device 67 has an external toothed rim 68 designed to cooperate with a corresponding internal toothed rim 16 on the reeling drum 4. This cooperation between the two coupling devices 15, 67 is achieved by the coupling device 67 of the central drive means 62 being displaced coaxially in relation to the coupling device 15 until connection occurs.

At the downstream end of the reel-up 1 (see FIG. 1) is a braking station 69 with a braking arm 70, in which braking station 69 the paper reel 3 is finally retarded before being carried further along the rails 12 to a reel-handling part of the machine (not shown). A cutter (not shown) may also be arranged upstream of the surface winding drum 8, which slits the paper web 2 into a number of narrower paper webs prior to reeling. The reel-up is provided with various indication means (not shown) for different types of measured values, such as sensing the position of the reeling drum 4 during the reeling process, which constitute technology familiar to one skilled in the art and are therefore not further described here. In other embodiments of the reel-up the surface winding drum in the embodiment described above may consist of a surface winding drum with a flexible jacket surface, a so-called soft surface winding drum, an endless supporting belt or a plurality of belts arranged parallel to each other.

Figure 7:
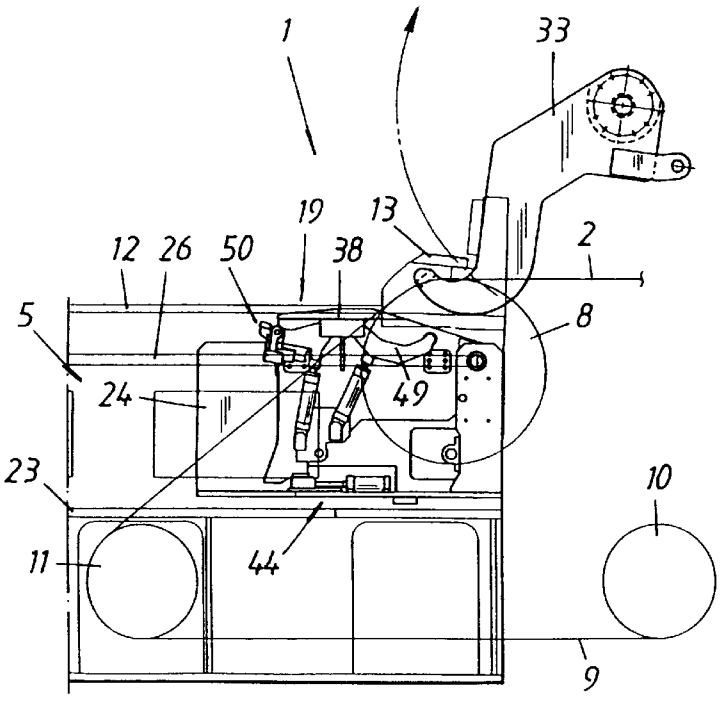
Figure 10:
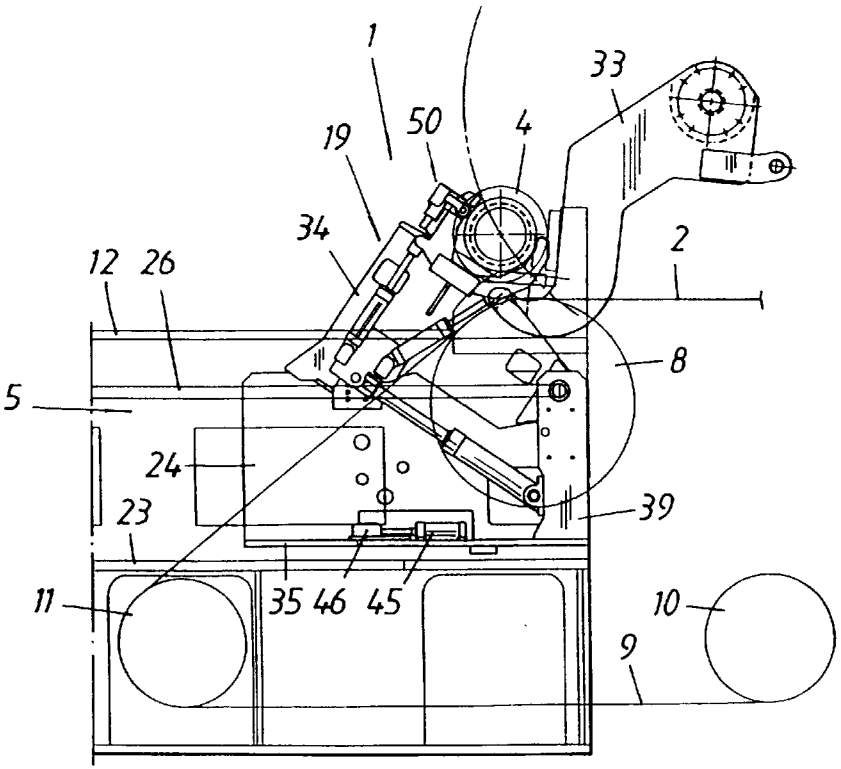
Figure 9:
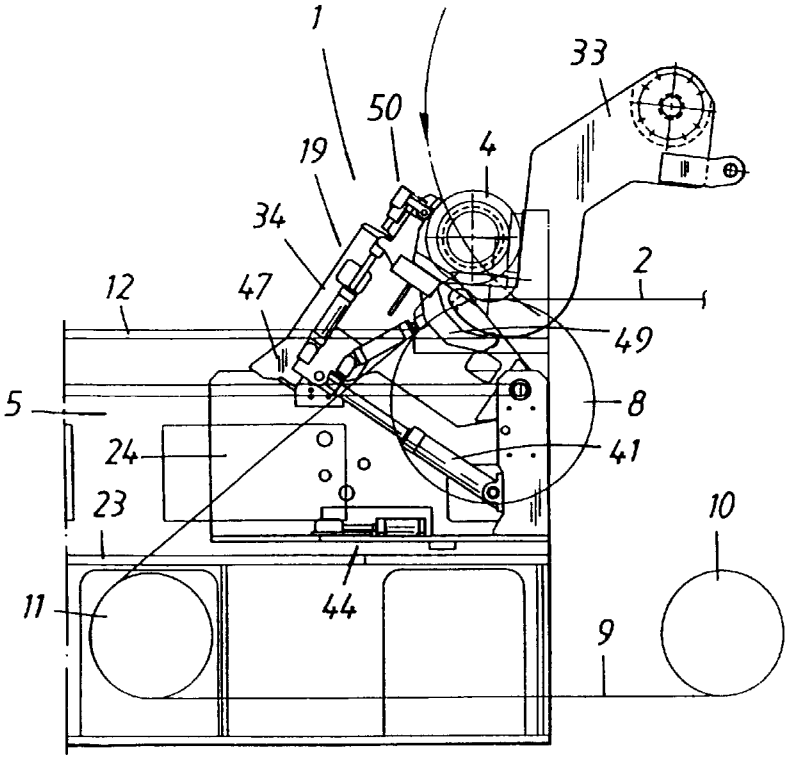
Figure 10:
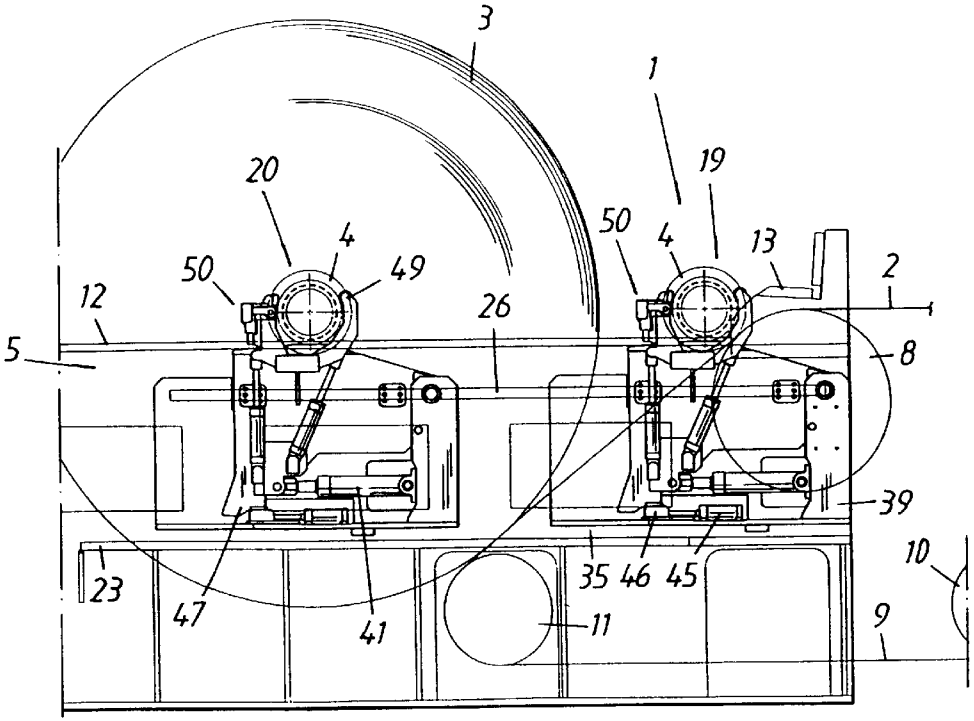
Figure 11:
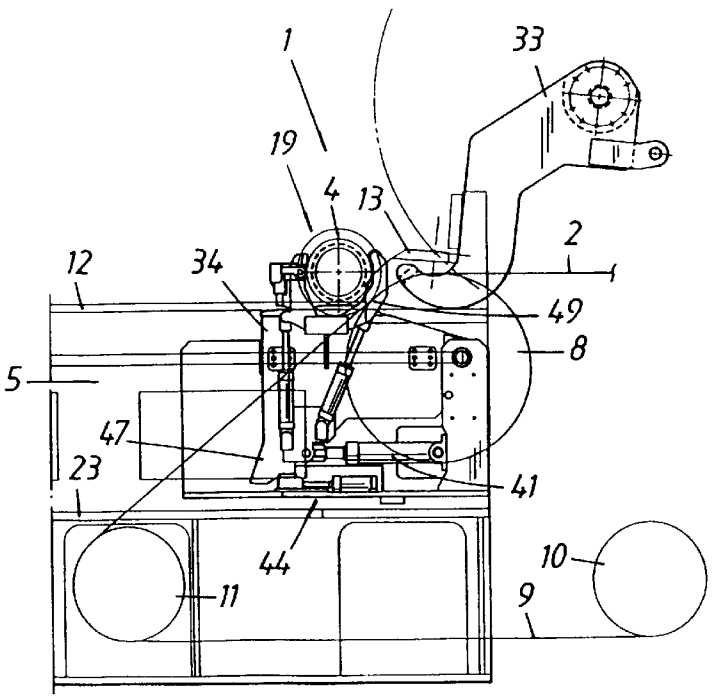
Figure 13:
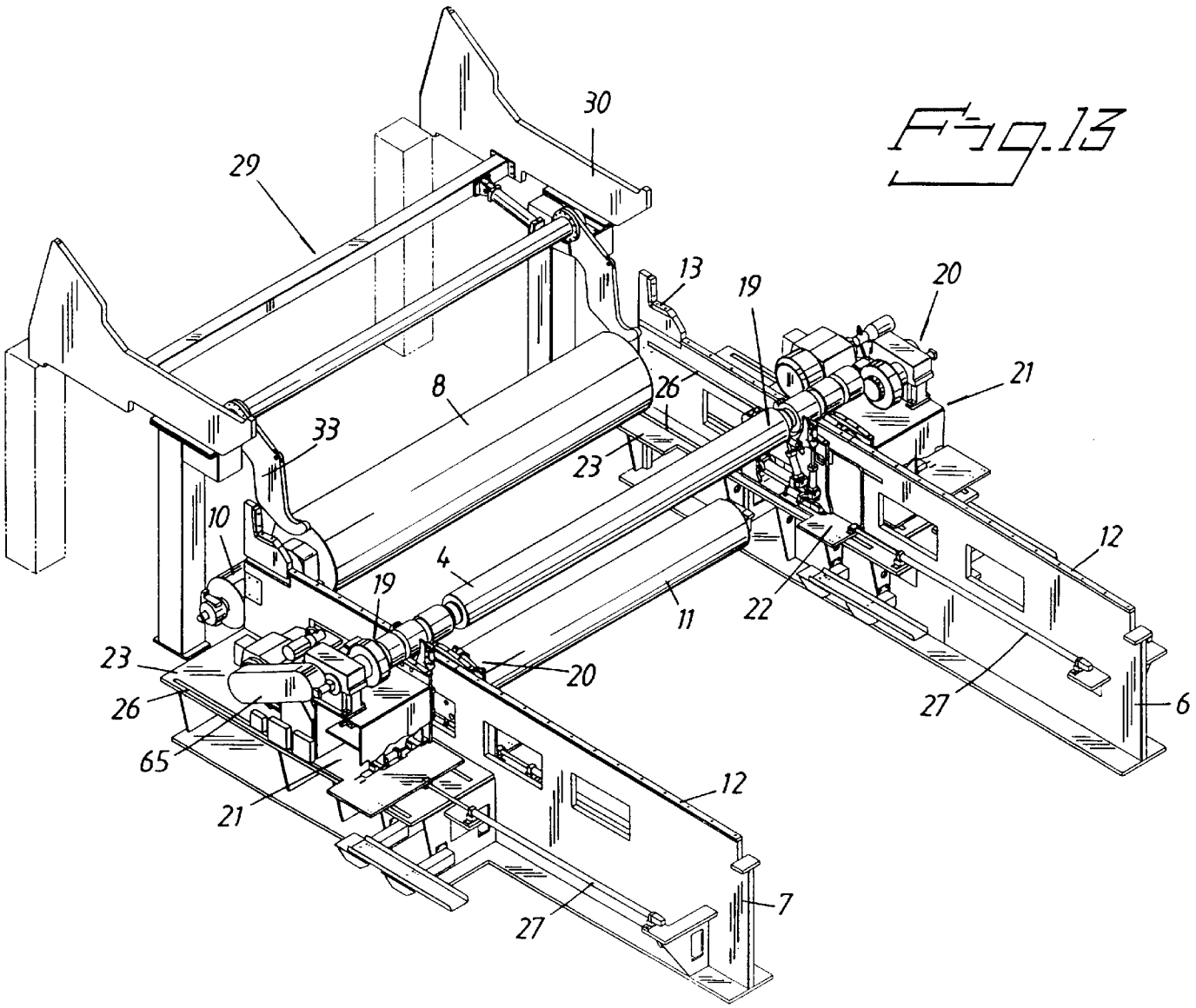
FIG. 13 is a schematic perspective view of the reel-up according to FIG. 1 showing the reel passage position with the paper reel removed for the sake of simplicity.

When the reeling process is started up in the reel-up 1 (see FIG. 7), the first secondary unit 19 is in its upstream position close to the surface winding drum 8 with the drive motor 63 of the central drive on the drive side and the other secondary unit 20 in its downstream position with the drive motor 63 of the central drive on the operator side.

Figure 14:
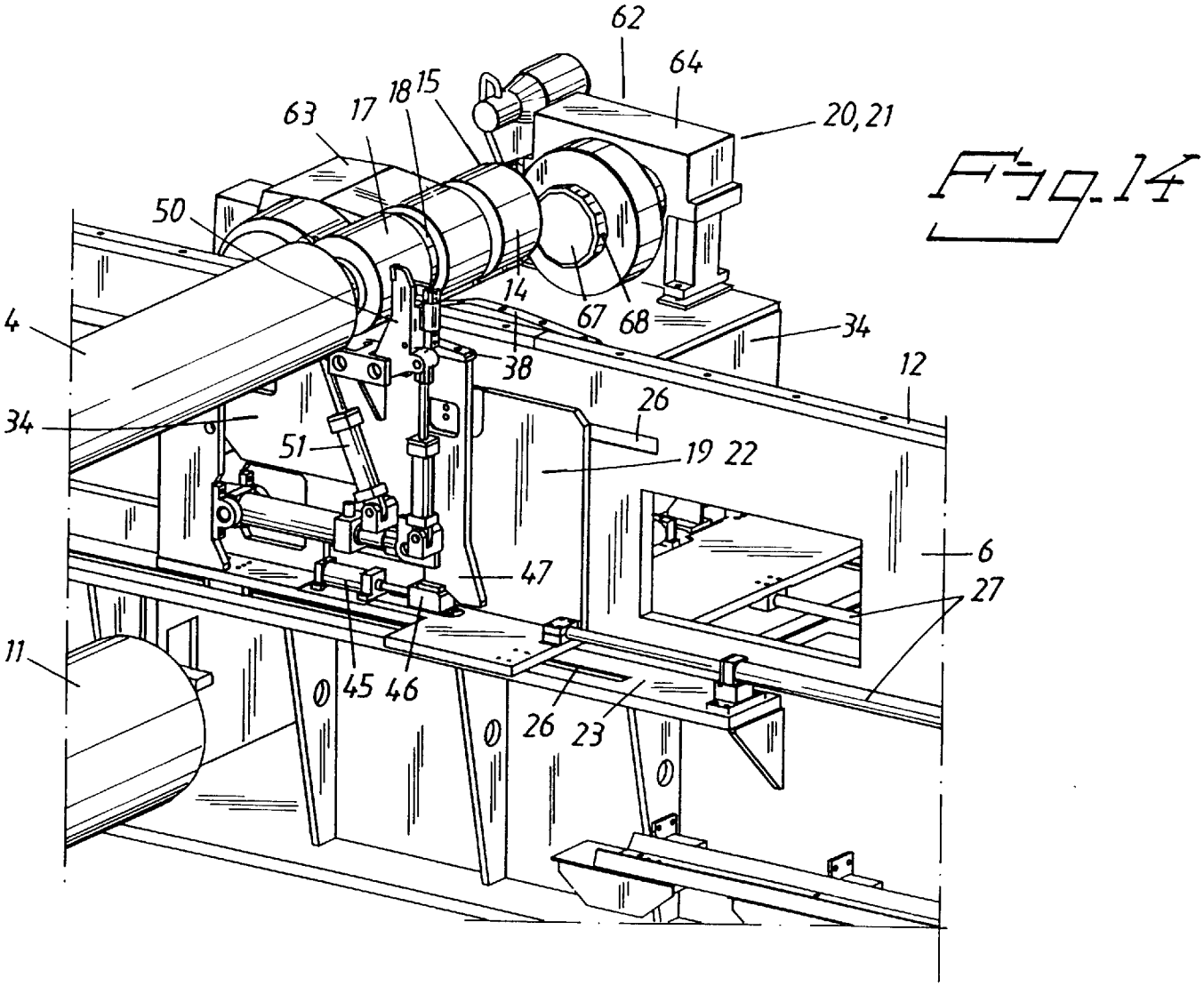
FIGS. 14 and 15 show respective inner secondary members while reel passage is in progress according to FIG. 13.
Figure 15:
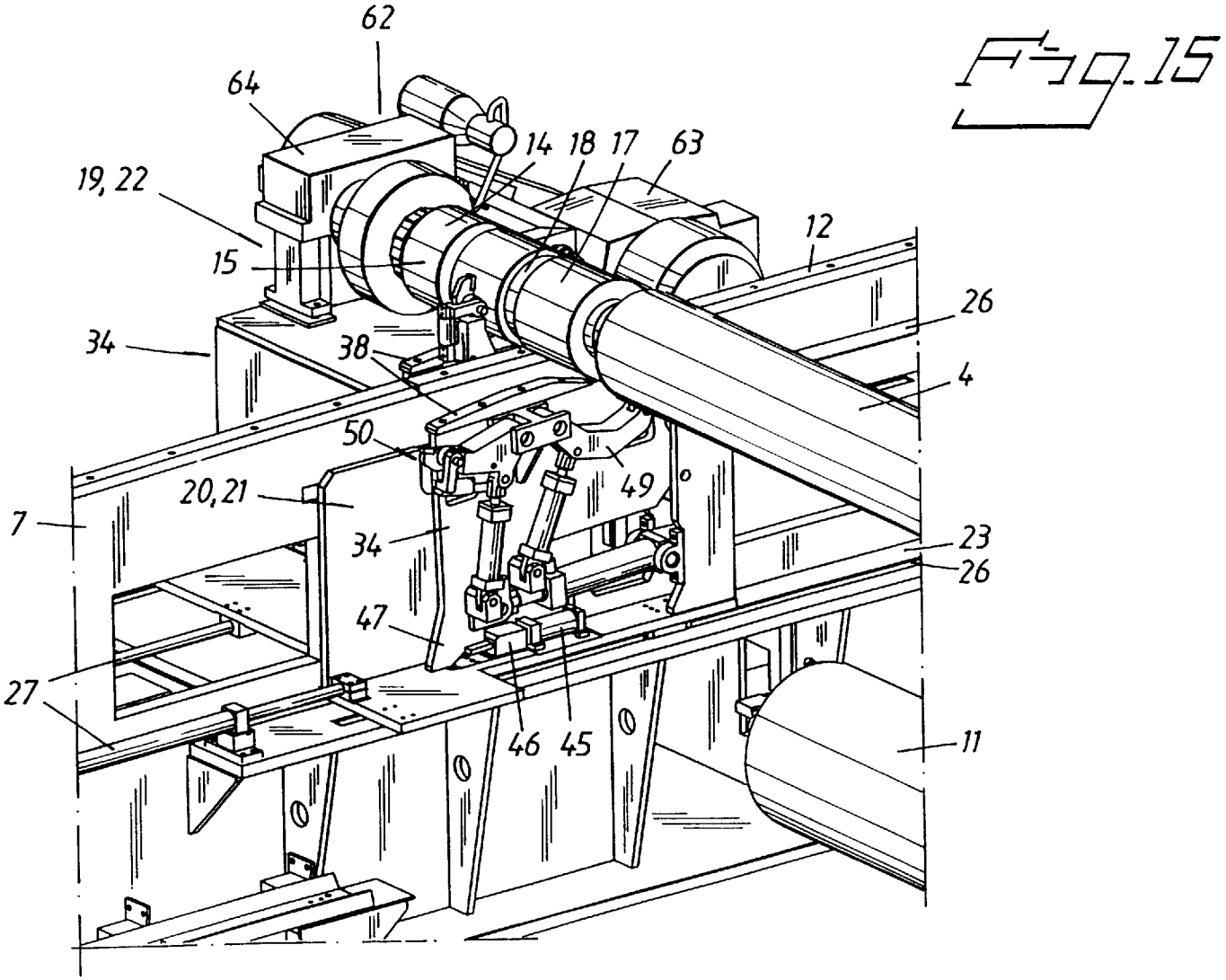
Figure 16:
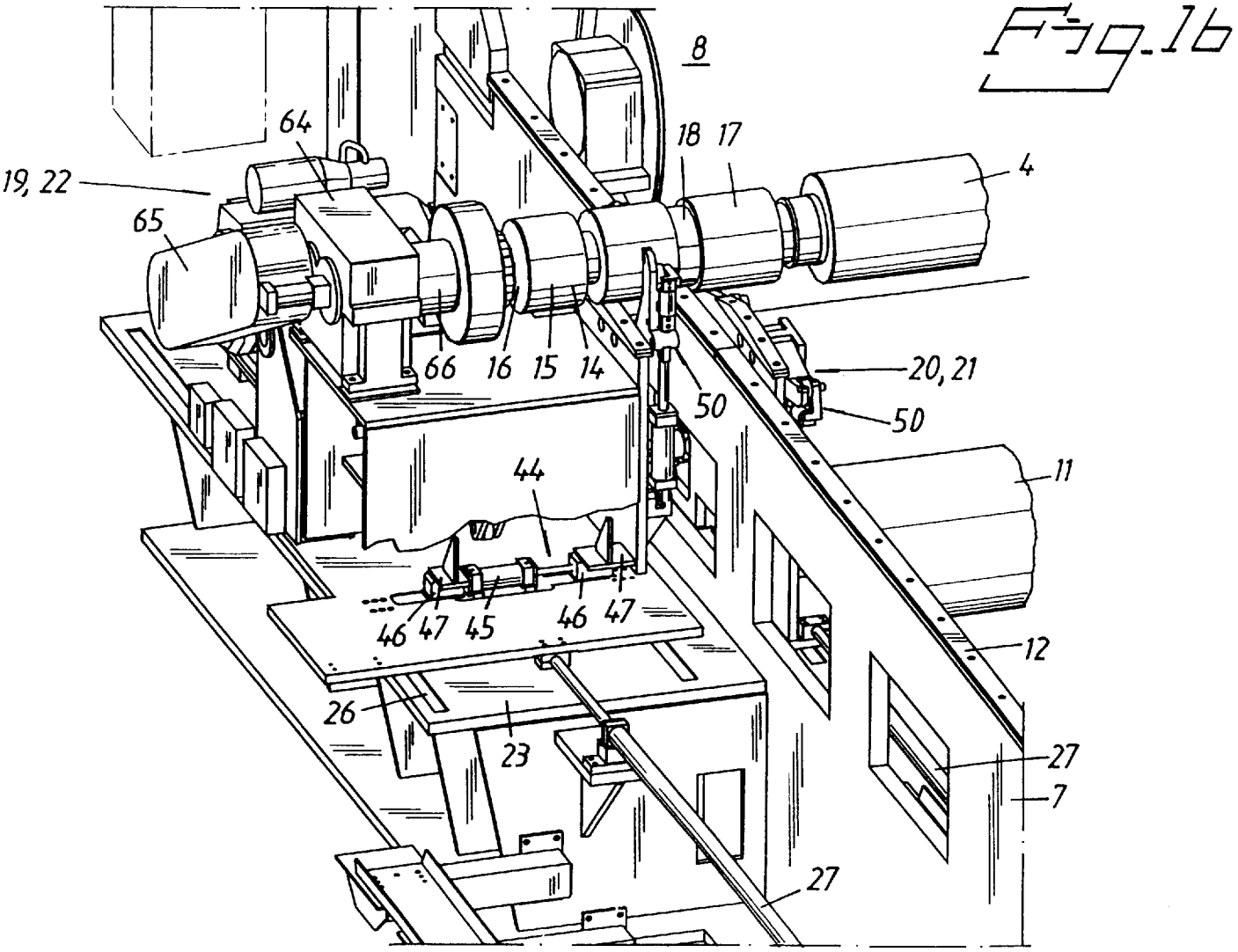
FIGS. 16 and 17 show respective outer secondary members while reel passage is in progress according to FIG. 13, with a part of the box cut away.
Figure 17:
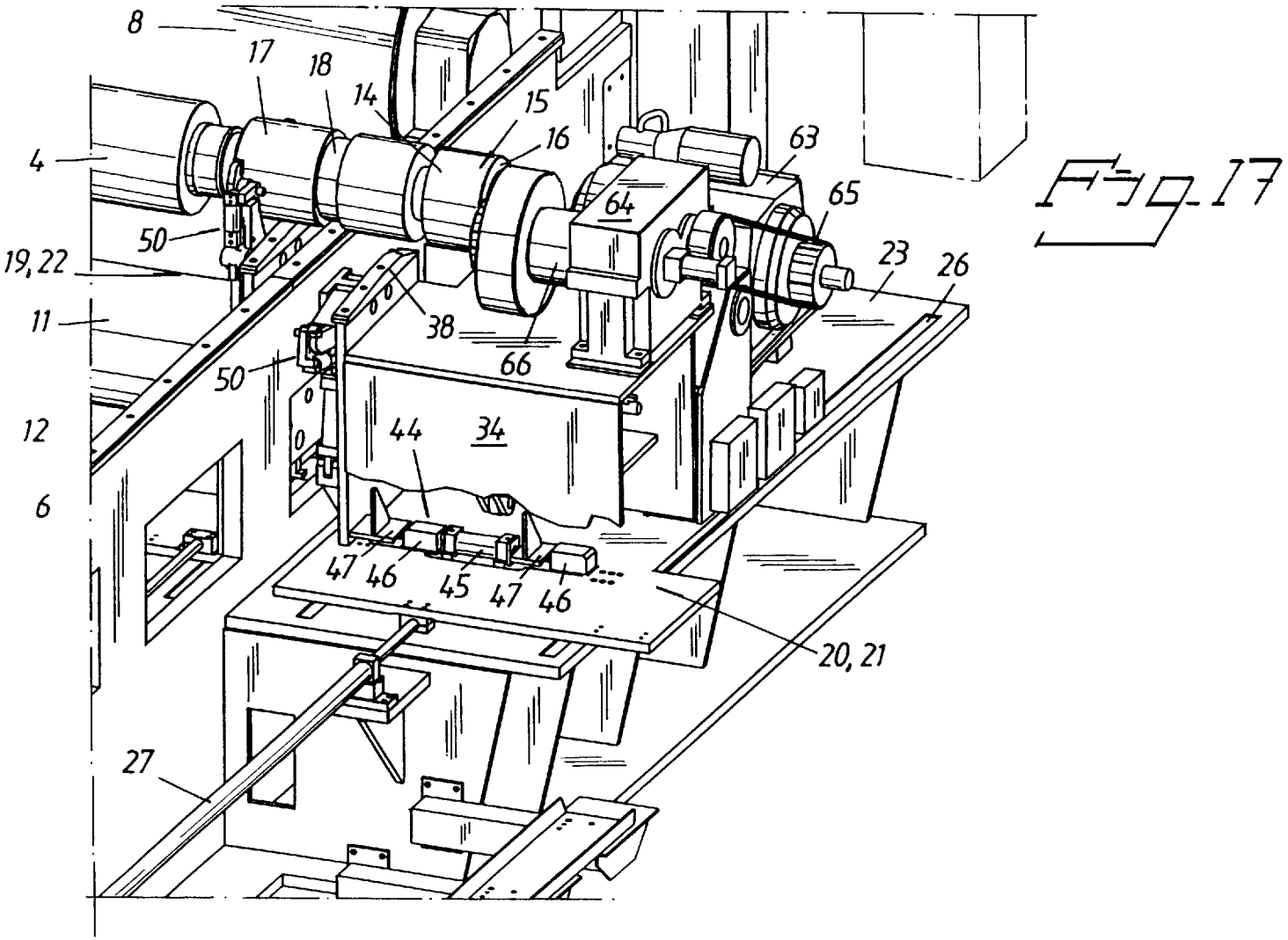

The pivot units 34 of the first secondary unit 19 are in their production positions, i.e. in folded-down position resting on the level blocks 46 pertaining to the upper surface of the position determiner 44 (see FIGS. 14 and 16, respectively). The pivot units 34 of the second secondary unit 20 are also in folded-down position, but rest directly on the bottom plate 35, which means that the reel-passage position has been assumed (see FIGS. 15 and 17, respectively).

All locking members 49 and press devices 50 in the two secondary units 19, 20 are in folded-down positions and thus with the gripping means open. The two central drive means 62 are stationary with the coupling devices 67 in their outermost positions.

A first reeling drum 4 is on the stock shelf 30 above the surface winding drum 8, ready to be gripped by the lowering arms 33 which are in their lowermost position. Downstream in the reel-up 1 the braking station 69 is ready with lowered braking arm 70 to receive and retard a finished paper reel 3. The cutting device, if any, is switched on but is not in production position.

When start has been initiated (see FIGS. 7–12) the pivot units 34 in the secondary unit 19 situated upstream are pivoted up to their upper position. The lowering arms 33 move up to the drum stock 29. A reeling drum 4 is caused to roll over to the lowering arms 33 and an indication is received when it has reached the correct position.

Figure 8:
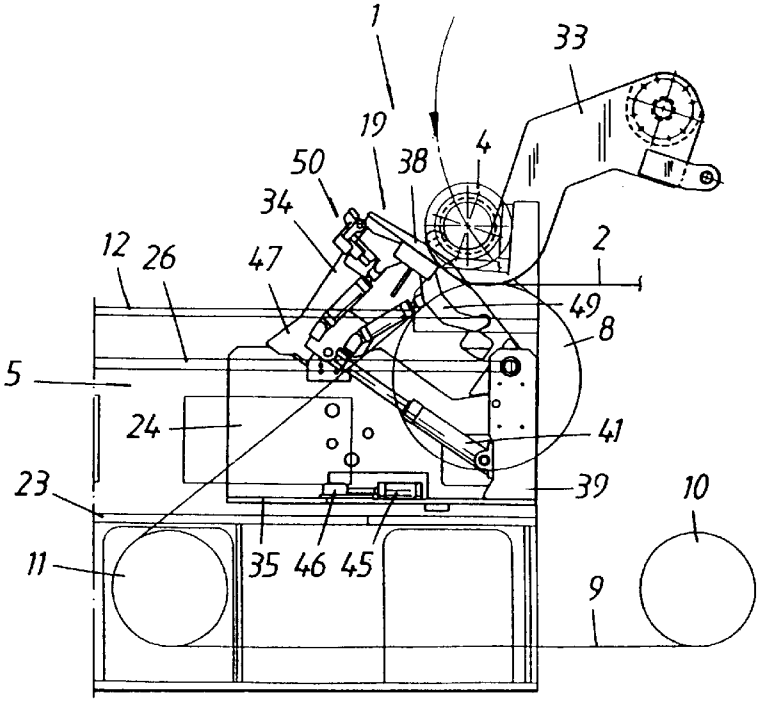

The lowering device 33 then moves down to the delivery position where the reeling drum 4 is placed on the raised lowering surface 13 of the rails 12, in the correct position just above the surface winding drum 8 (see FIG. 8). In the stock 29 the next empty reeling drum 4 is moved forward ready for the next cycle by an actuator (not shown) provided for that purpose.

The press device 50 moves up to its collecting position. The lowering arms 33 are lowered further so that the reeling drum 4 now rests freely on the rails of the lowering surface 13. The actuator 51 of the locking member 49 is actuated so that the locking arms 54 move up (see FIG. 10) and, together with the press device 50, grip the reeling drum 4 and fix it in its starting position. The coupling device 67 of the central drive means 62 begins to move out in axial direction while the drive motor 63 is actuated, initially with low speed. When the toothed rims 16, 68 of the two coupling devices 15 and 67 have engaged and coupling has been achieved, this is indicated. A screen (not shown) to eliminate the effects of the air flow around the rotating surface winding drum 8 is lowered. The central drive means 62 now accelerates the reeling drum 4 to the same peripheral speed as that of the surface winding drum 8, in order to avoid friction when these are brought into contact with each other. The pivot units 34 are lowered towards the surface winding drum 8 and the endless belt 9 carrying the paper web 2 (see FIG. 11).

A vacuum arrangement (not shown) may be connected to the reeling drum 4 which in that case is perforated. When contact is achieved with the paper web 2 a transition occurs, the paper web 2 being transferred in suitable manner to the reeling drum 4, see below.

The actual transition may be achieved in several different ways. The paper web 2 may be attached by means of suction, for instance, and pulled off at the vacuum perforations in the reeling drum 4, or the growing reel 3 may be retarded so that a surplus of paper 2 arises and is drawn into the nip where it is then pulled off. Alternatively glue or tape may be applied on the reeling drum 4.

If the paper web 2 is to be divided into several webs, the cutter is lowered and put into operation. The secondary bodies 24 are now positioned in succession outwardly from the surface winding drum 8 in order to obtain a constant impression in the endless belt 9. The first secondary unit 19 moves horizontally along the stand 5 as the paper reel 3 grows, whereas the secondary unit 20 starts to move upstream towards the surface winding drum 8. It passes below the growing reel 3 thanks to the clearance obtained between the secondary units 19, 20 with the aid of the position determiner 44 (see FIGS. 13–17).

After passage, when the second secondary unit 20 has reached its uppermost upstream position, the pivot units 34 pertaining to said second secondary unit 20 are rotated to their top position, whereupon the position determiner 44 is again set in production position (see FIG. 8) by the actuator 45 moving the level block 46 to its front position. The lowering arms 33 are again raised to collect a new empty reeling drum 4.

In the meanwhile the growing reel 3 has achieved its final size and reached the braking station 69. The reel 3 is retarded to approximately 20% of production speed, whereupon the central drive means 62 is disconnected. The drive means is then stopped entirely and the reel is transferred to the reel-handling part (not shown) of the reel-up 1. The process then starts again.

In the embodiment shown the belt continues to support and also drive the paper web to the finished paper reel at the same time as the new reeling drum comes into contact with the belt and the paper web is wrapped around the new reeling drum, which is described in more detail in U.S. Pat. No. 5,531,396. According to an alternative embodiment, shown in more detail in FIG. 18, the new reeling drum is in contact with the endless belt whereas the finished reel leaves said belt on its movement downstream.

Figure 18:
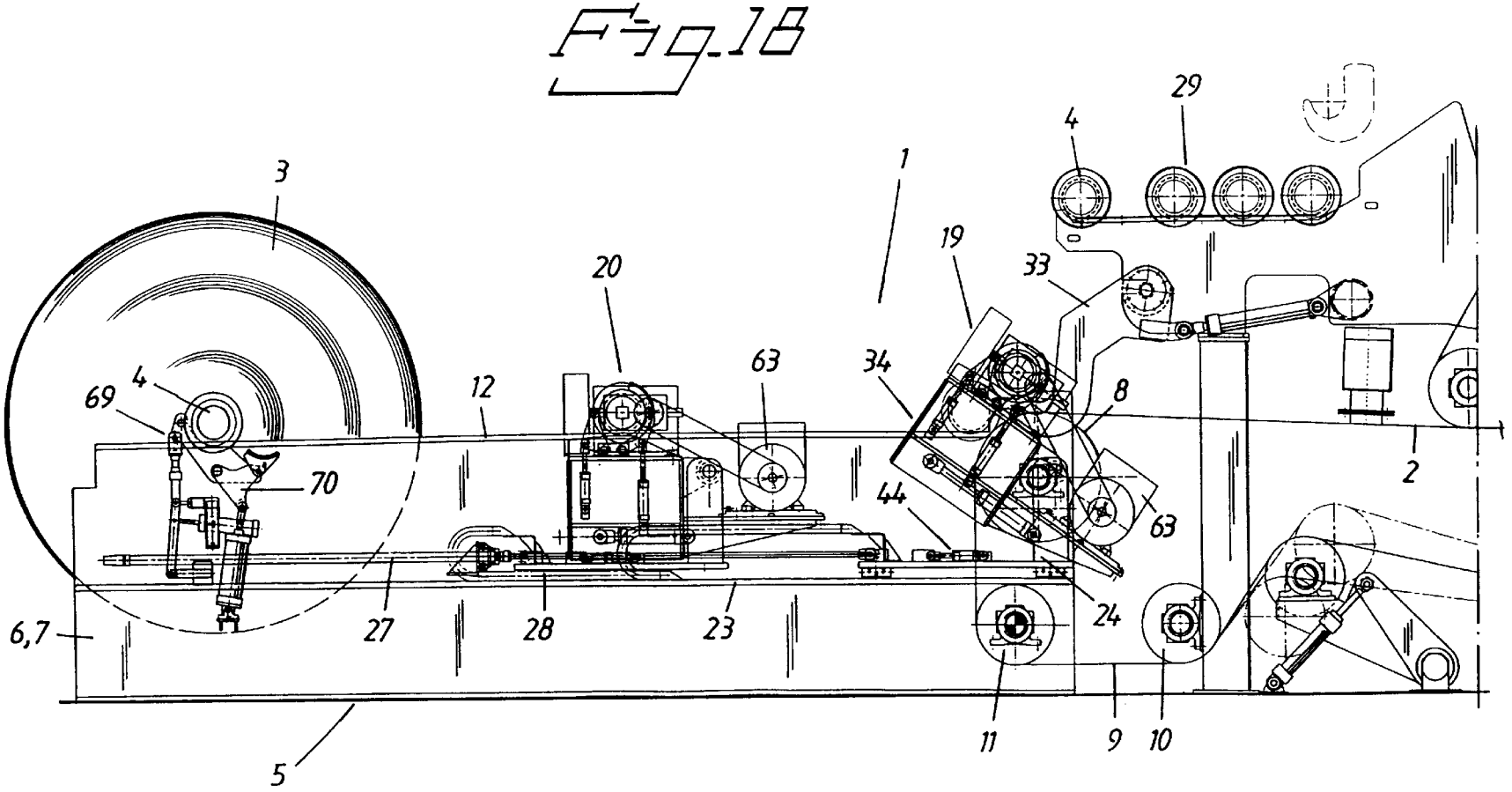
FIG. 18 is a longitudinal cross section of a reel-up according to an alternative embodiment in which the finished paper reel runs free from the endless belt during its movement downstream.

In the embodiment of the invention described above and shown in the drawings, the surface winding means comprises a surface winding drum 8 and a belt 9. However it is also possible for the surface winding means in a first extreme case to consist of only the surface winding drum 8, without the use of any belt 9, as in a conventional drum reel-up. In another extreme case the surface winding means may, as well as the belt 9, also comprise a roll in the form of a guide roll 8 in which case the configuration is such that both the wrapping of the web 2 around a new reeling drum 4 and continued reeling of the web 2 on the reeling drum 4 are performed against a portion of the belt 9 that is not directly supported. The guide roll 8 does not therefore act as surface winding drum. If a belt is used the nose section may be inclined downwardly as shown in FIGS. 1–17 or may be vertical as shown in FIG. 18. Alternatively the belt 9 may turn around the surface winding drum 8 and run back from this towards the drying section of the tissue machine.

That which is claimed is:

1. A reel-up in a paper machine in which paper is produced in a continuous web and reeled up on reeling drums to form paper reels, said reel-up comprising:

two elongate parallel stand members each having an upstream end and a downstream end;

a moving winding surface arranged at the upstream end of the stand members to carry the web and deliver the web to a reeling drum;

a primary device for moving empty reeling drums to a position adjacent to the parallel stand members to commence a reeling operation; and first and second pairs of secondary members for alternate receipt of each empty reeling drum, one secondary member of each of said pairs being arranged between said stand members and the other secondary member of the respective pair being arranged outside of said stand members, each of said secondary members comprising;

a support member adjacent to a respective stand member, a linear actuator for linearly moving the support member in a direction parallel to the stand member, a press device pivotally supported on said support member for engaging an end of an empty reeling drum and pressing the reeling drum against the winding surface so that a predetermined linear nip pressure is maintained as the paper reel increases in size, and an actuator for pivoting the press device between a collection position folded away from the support member for collection of an empty reeling drum and a production position folded towards the support member for reeling the web onto the collected reeling drum.

2. A reel-up as claimed in claim 1 wherein each of said press devices is also pivotable from the production position down to a free-passage position such that the press devices of a pair of secondary members in the free-passage position can pass beneath a reeling drum supported on the other pair of secondary members in the production position.

3. A reel-up as claimed in claim 2 wherein each secondary member further comprises at least one horizontally movable level block mounted to said support member and a cooperating shoulder connected to said press device, said level block movable between a first position wherein said press device is in the production position and a second position wherein said press device is in the free-passage position.

4. A reel-up as claimed in claim 1 wherein the winding surface comprises a surface winding drum rotatably journalled in the stand members.

5. A reel-up as claimed in claim 1 wherein the winding surface comprises at least one endless running support belt arranged at the upstream end of the stand members.

6. A reel-up as claimed in claim 5 further comprising a surface winding drum within said support belt against which the reeling drum is initially engaged, said support belt being arranged to maintain engagement with the paper reel as the reel grows and is moved away from the surface winding drum.

7. A reel-up as claimed in claim 1 further comprising a drum stock and a pair of lowering surfaces adjacent the upstream end of the stand members, and wherein the primary device for moving empty reeling drums comprises a pair of lowering arms pivotably arranged to move between a first position folded up for collecting a new reeling drum from the drum stock and a second position folded down for delivering the reeling drum onto the lowering surfaces.

8. A reel-up as claimed in claim 7 wherein the lowering arms are arranged to be moved to a further third position free from the reeling drum delivered to the lowering surfaces.

9. A reel-up as claimed in claim 1 wherein each stand member further comprises a rail along an upper edge thereof such that the ends of each reeling drum are at least partially supported by said rails during reeling of the paper web.

10. A reel-up as claimed in claim 1 wherein each press device further comprises a vertical support plate and a rail along an upper edge of said vertical support plate such that the ends of each reeling drum are at least partially supported by said rails during reeling of the paper web.

11. A reel-up as claimed in claim 1 wherein each secondary body further comprises a locking member cooperating with said press device for locking the reeling drum against translational movement relative to the secondary member.

12. A reel-up as claimed in claim 1 further comprising a load cell associated with each of said secondary members for sensing the linear pressure in the nip between the winding surface and the paper reel and varying the linear position of said support member and the pivotal position of said press device in order to control the linear pressure.

13. A reel-up as claimed in claim 1 wherein each secondary member which is outside of said stand members further comprises a central drive arranged to be brought into engagement with and drive a respective reeling drum.

14. A reel-up as claimed in claim 13 wherein the central drive further comprises a drive motor, a shaft, and a coupling device arranged on said shaft for engagement of the reeling drum along the axis thereof.

15. A secondary system for a reel-up of a paper machine having a moving winding surface for carrying and delivering the web, said secondary system comprising:

a first pair of secondary members for receipt of an empty reeling drum, each of said secondary members comprising;

a support member, a linear actuator for linearly moving the support member in a direction towards the winding surface, a press device pivotally supported on said support member for engaging an end of an empty reeling drum and pressing the reeling drum against the winding surface so that a predetermined linear nip pressure is maintained as the paper reel increases in size, and an actuator for pivoting the press device between a collection position folded away from the support member for collection of an empty reeling drum and a production position folded towards the support member for reeling the web onto the collected reeling drum, and a second pair of secondary members for alternate receipt of an empty reeling drum, each of said secondary members comprising;

a support member, a linear actuator for linearly moving the support member in a direction towards the winding surface, a press device pivotally supported on said support member for engaging an end of an empty reeling drum and pressing the reeling drum against the winding surface so that a predetermined linear nip pressure is maintained as the paper reel increases in size, and an actuator for pivoting the press device between a collection position folded away from the support member for collection of an empty reeling drum and a production position folded towards the support member for reeling the web onto the collected reeling drum.

16. A secondary system for a reel-up as claimed in claim 15 wherein each of said press devices is also pivotable from the production position down to a free-passage position such that the press devices of a pair of secondary members in the free-passage position can pass beneath a reeling drum supported on the other pair of secondary members in the production position.

17. A secondary system for a reel-up as claimed in claim 16 wherein each secondary member further comprises at least one horizontally movable level block mounted to said support member and a cooperating shoulder connected to said press device, said level block movable between a first position wherein said press device is in the production position and a second position wherein said press device is in the free-passage position.

18. A secondary system for a reel-up as claimed in claim 15 wherein each press device further comprises a vertical support plate and a rail along an upper edge of said vertical support plate such that the ends of each reeling drum are at least partially supported by said rails during reeling of the paper web.

19. A secondary system for a reel-up as claimed in claim 15 wherein each secondary body further comprises a locking member cooperating with said press device for locking the reeling drum against translational movement relative to the secondary member.

20. A secondary system for a reel-up as claimed in claim 15 further comprising a load cell associated with each of said secondary members for sensing the linear pressure in the nip between the winding surface and the paper reel and varying the linear position of said support member and the pivotal position of said press device in order to control the linear pressure.

21. A secondary system for a reel-up as claimed in claim 15 wherein each secondary member which is outside of said stand members further comprises a central drive arranged to be brought into engagement with and drive a respective reeling drum.

22. A reel-up as claimed in claim 21 wherein the central drive further comprises a drive motor, a shaft, and a coupling device arranged on said shaft for engagement of the reeling drum along the axis thereof.

* * * * *

UNITED STATES PATENT AND TRADEMARK OFFICE
CERTIFICATE OF CORRECTION

PATENT NO. : 5,816,528

DATED : October 6, 1998

INVENTOR(S) : Ekstrom et al.

It is certified that error appears in the above-identified patent and that said Letters Patent is hereby corrected as shown below:

In the Abstract, line 8, after "unit" omit the comma (,).

Column 10, line 44, "body" should read --member--.

Column 12, line 16, "body" should read --member--.

Signed and Sealed this

Second Day of March, 1999

*Attest:*

Q. TODD DICKINSON

*Attesting Officer*

*Acting Commissioner of Patents and Trademarks*